United States Patent [19]

Tanaka et al.

[11] Patent Number: 4,854,211

[45] Date of Patent: Aug. 8, 1989

[54] ACTION MECHANISM OF AN UPRIGHT PIANO

[75] Inventors: Hajime Tanaka, Yamaguchi; Shiro Saito, Shizuoka, both of Japan

[73] Assignee: Tanaka International Co., Ltd., Yamaguchi, Japan

[21] Appl. No.: 93,707

[22] Filed: Sep. 8, 1987

[30] Foreign Application Priority Data

Sep. 9, 1986 [JP] Japan ..... 61-212427
Sep. 9, 1986 [JP] Japan ..... 61-138348[U]

[51] Int. Cl.[4] ..... G10C 3/18
[52] U.S. Cl. ..... 84/240; 84/253
[58] Field of Search ..... 84/236, 240, 241, 242, 84/253, 255, 217, 218

[56] References Cited

U.S. PATENT DOCUMENTS

| | | | |
|---|---|---|---|
| 179,029 | 6/1876 | Koth | 84/253 |
| 204,752 | 6/1878 | Neill | 84/253 X |
| 426,332 | 4/1890 | Schaaf | 84/240 |
| 896,763 | 8/1908 | Schimmel | 84/239 |

FOREIGN PATENT DOCUMENTS

| | | |
|---|---|---|
| 74725 | 9/1892 | Fed. Rep. of Germany . |
| 73461 | 2/1893 | Fed. Rep. of Germany . |
| 2155211 | 11/1971 | Fed. Rep. of Germany . |
| 58-108496 | 7/1983 | Japan . |
| 226616 | 1/1925 | United Kingdom . |
| 332328 | 7/1930 | United Kingdom . |

OTHER PUBLICATIONS

U.S. patent application Ser. No. 815,458, filed 1/2/86, Bafunno Pasquale.

*Primary Examiner*—L. T. Hix
*Assistant Examiner*—Brian W. Brown
*Attorney, Agent, or Firm*—Wenderoth, Lind & Ponack

[57] ABSTRACT

An action mechanism for a upright piano includes a back check mechanism having a back check member provided on the horizontal arm of a hammer arranged to strike a string and a hammer check disposed upright on a wippen constituting an escapement mechanism. With an upright piano incorporating this back check mechanism, it is possible to satisfactorily produce a rapid repetition of a tone with a sound quality approximately that which up until now could only be provided with a grand piano.

3 Claims, 5 Drawing Sheets

ACTION MECHANISM OF AN UPRIGHT PIANO

BACKGROUND OF THE INVENTION

The present invention relates to an improved action mechanism for pianos, in particular, upright pianos and A piano playing technique called "repetition" is known in which, immediately after a hammer has struck a string following the depression of a piano key, the same piano key is depressed again before it completely returns to its original position, thereby producing the same tone.

This playing technique is utilized, for example, when the same tone is to be rapidly and continuously produced for a short period of time in a trill-like manner. If a grand piano is played using this technique, a complete form of repetition can be performed. This is facilitated by a known type of double escapement mechanism D and a known type of back check mechanism B which are typically incorporated in a conventional grand piano as shown in FIG. 5.

In general, in order to enable a rapidly repetitive striking of a piano string, it is necessary to employ a mechanism which acts according to the speed of depression of a piano key to return a hammer to predetermined position, which stops the return of the hammer at an intermediate position, or which limits the speed of return of the hammer utilizing the force of a spring or the like. The aforementioned escapement mechanism and back check mechanism are used to satisfy this requirement.

However, although a conventional type of upright piano may include the back check mechanism B as shown in FIG. 3, the double escapement mechanism D cannot be incorporated due to structional limitations.

It is to be noted that Japanese Utility Model Laid-open No. 108,496/1983 discloses an arrangement in which a double escapement mechanism is incorporated in an action mechanism of an upright piano.

The upright piano disclosed in this publication performs a function equivalent to that of an action mechanism for a grand piano in which, for example, as shown in FIG. 4, the depressing force applied to a piano key K is transmitted to a hammer H through the intermediary of a double escapement mechanism D of the type typically used in a grand piano. The disclosed upright piano further includes a type of back check mechanism B typically used in an upright piano as shown in FIG. 3.

However, as shown in FIG. 4, such an arrangement requires a relatively large second wippen 11*a*, as well as a first wippen 11. Although the back check mechanism B can move freely, the size of the escapement mechanism must significantly relatively small. It is thus impossible to obtain a satisfactory effect with this escapement mechanism, and the key touch quality inevitably suffers due to the weight and structure of the second wippen 11*a*. In addition, the presence of a tape T connecting the hammer H and a horizontal arm 12 may cause various problems. Therefore, the action structure shown in FIG. 4 has not yet been put to practical use.

Accordingly, although upright pianos may have various advantages such as their relatively small size, inexpensive price, and convenient operability, they are seldom used for public performances such as concerts. For this reason, some of students of the piano are finally forced to purchase a grand piano to practice on.

It is to be noted that the term "back check mechanism (B)" used herein is defined as a mechanism which can be incorporated in any grand piano or upright piano and in which, while a hammer is returning reactively after striking a string, the hammer is received at an intermediate position between the striking position and the rest position, thereby allowing a jack to positively strike the hammer at the succeeding depression of the same piano key.

SUMMARY OF THE INVENTION

It is therefore an object of the present invention to provide an action mechanism for an upright piano which assures a satisfactory musical performance at all times and which, in addition, enables rapidly repetitive playing techniques such as a trill to be used even with a typical upright piano, just as in a grand piano.

The above-described object is achieved by the present invention which provides an improvement in an action mechanism of an upright piano in which a depressing force applied to a piano key disposed on a key frame is transmitted by a pillar attached to one end of each key to an L-shaped hammer through the intermediary of as escapement mechanism attached to a fixed frame, the improvement comprising:

a support frame for supporting the L-shaped hammer to allow swinging movement of the L-shaped hammer in an direction away from a string under the force of gravity; and a back check mechanism including a back check member provided on one end of a horizontal arm of the L-shaped hammer and a hammer check upright on a wippen of the escapement mechanism.

With this inventive arrangement, after a piano key has been depressed to cause the hammer to strike an associated string to produce a tone, the escapement mechanism and the back check mechanism cooperate with each other to automatically place the hammer in a striking enable position before restoring the piano key to its initial position.

The previously described object is also achieved by the provision in the present invention of a back check mechanism in an upright piano in which a depressing force applied to a piano key is transmitted to an L-shaped hammer through the intermediary of an action mechanism to cause the L-shaped hammer to strike a string, the mechanism comprising:

a back check member provided on one end of a horizontal arm of the L-shaped hammer;

a resilient wire screwed into a wippen of the action mechanism and extending through a through-hole formed in the horizontal arm of the L-shaped hammer; and a hammer check attached to the resilient wire so as to project therefrom and engage the back check member within the radius of a circular arc traced by the back check member.

With this arrangement, the positional relationship between the hammer check and the back check member can be easily adjusted at any time. In addition, the hammer can be made to strike a string without a risk of the hammer check colliding with the horizontal arm of the hammer, and also the back check member positively comes into slidable contact with the hammer check. Thus, a performer can obtain a satisfactory musical performance using an upright piano.

Further objects, features and advantages of the present invention will become apparent from the following description of a preferred embodiment of the present invention with reference to the accompanying drawings.

DETAILED DESCRIPTION OF THE PREFERRED EMBODIMENT

Figure 1:
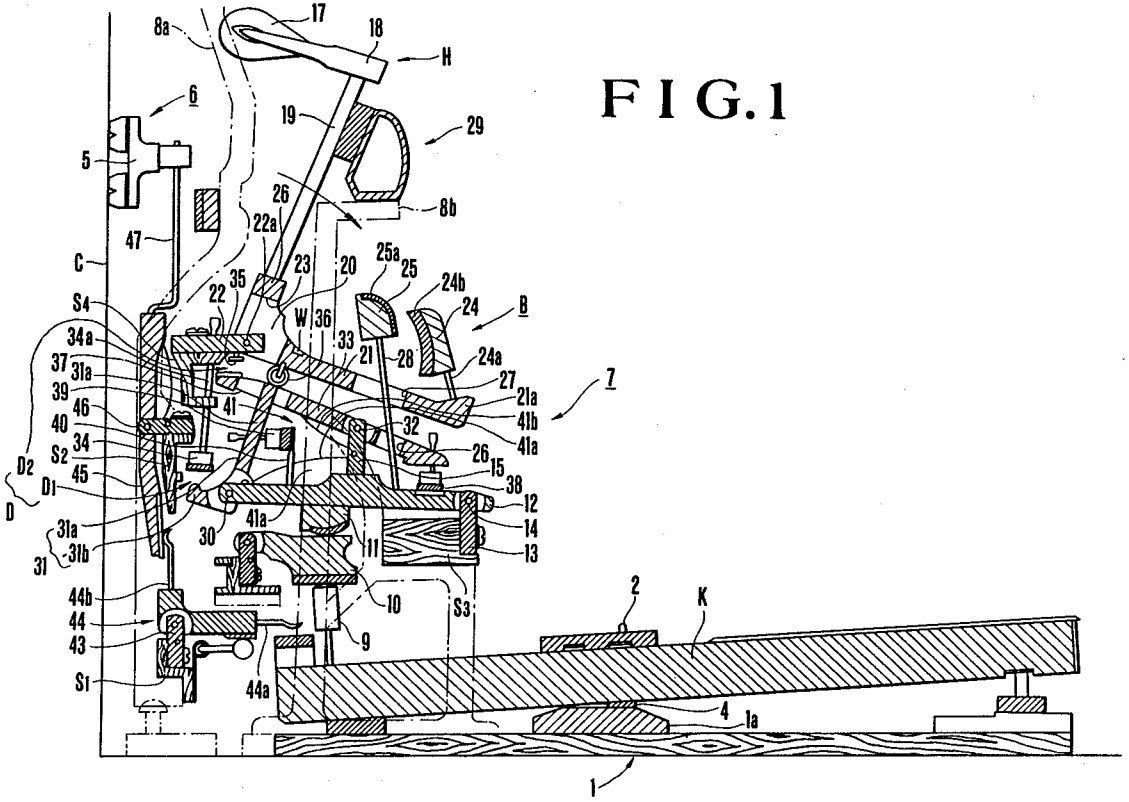
FIG. 1 is a side view, partially in section, of a preferred embodiment of the present invention.

A preferred embodiment of the present invention will be described below with reference to the accompanying drawings in which like reference numeral are used to identify identical elements throughout the several views.

Referring first to FIG. 1, a plurality of piano keys K are arranged on a keyboard (not shown), and each of the piano keys K is supported on a key frame 1 fixed to a key bed (not shown). The piano key K is attached to a central key frame 1*a* on the key frame 1 for facilitating a swinging motion of the key about a pin 2.

It is to be noted that a felt pad 4 is provided on the lower surface of the piano key K which faces the central key frame 1*a*.

When the piano key K is depressed, the depressing force applied to the piano key K is transmitted therethrough to the action mechanism. In the presently preferred embodiment, however, immediately after such a depression, the depressing force is transmitted to first and second mechanisms. The first mechanism 6 includes a damper 5 which is adapted to be pressed against a string C for damping the vibration of the string C, and means for moving the damper 5 into and out of contact with the string C. The second mechanism is an action mechanism 7 arranged to cause a hammer H to strike the string C.

Support frames $S_1$ and $S_2$ are secured to a fixed frame 8a shown in phantom and support frames $S_3$ and $S_4$ are secured to another fixed frame 8*b*. The aforesaid first mechanism 6 is supported by the support frames $S_1$ and $S_2$ while the action mechanism 7 is supported by the support frames $S_3$ and $S_4$.

In this manner, the first mechanism 6 and the action mechanism 7 are separately supported by the support frames $S_2$ and $S_4$. With this arrangement, the tone produced by the string C which has been struck by the hammer H can be easily damped by means of a damper pedal.

In general, a typical piano is arranged such that a tone is produced by striking three strings at the same time and, in order to produce a damped tone, two of the three are struck by the hammer H. In the latter case where the hammer H strikes two of the three strings, the associated action mechanism 7 is displaced laterally and parallel to the three strings. This lateral displacement of the action mechanism 7 is relatively easily enabled by the separate arrangement of the first mechanism 6 and the action mechanism 7. For this reason, the first mechanism 6 is supported by the support frame $S_2$ which is disposed separately from the support frame $S_4$ that provides support for the action mechanism 7.

First, the action mechanism 7 will be described below. The action mechanism 7 includes a pillar 9 adjustably bolted to each of the piano keys K, and a wippen heel 11 is supported via a wippen joint member 10 on the pillar 9.

The upper surface of the pillar 9 is semispherical while the lower surface of the wippen heel 11 is also semispherical. The force applied to the piano key K is smoothly transmitted through the intermediary of the pillar 9, the wippen joint 10 and the wippen heel 11 in the upward direction as viewed in FIG. 1 with frictional resistance limited to an extremely low level. In addition, this arrangement enables the removal of the action mechanism 7.

The wippen heel 11 is attached at its upper surface to a wippen 12 constituting the double escapement mechanism D which will be described later. As shown, the right-hand end of the wippen 12 is pivotally supported by a shaft 14 attached to a wippen fork 13 which projects from the support frame $S_3$ in the upward direction as viewed in FIG. 1. A repetition lever fork 15 is nearly fixed nearly upright in the substantially lengthwise mid-portion of the wippen 12 which is located to the right of the wippen heel 11. The repetition lever fork 15 constitutes one part of the double escapement mechanism D.

The following is a description of the hammer H, and the double escapement mechanism D will be described in detail later.

Referring to FIG. 1, the hammer H is substantially L-shaped and includes an upright arm 19 having one end provided with a hammer felt pad 17 and a hammer wood 18; and a horizontal arm 21 connected via a boss portion 20 to the other end of the upright arm 19. The boss portion 20 is pivotally supported by a shaft 22*a* attached to a fixed bracket 22 which projects from the support frame $S_4$ to the right as viewed in FIG. 1.

In the presently preferred embodiment, the support frames $S_2$ and $S_4$ are formed by drawing aluminum and the shaft 22*a* is positioned as close to the string C as possible, thereby enabling the hammer H to strike the string C while extending substantially horizontally.

The aforesaid boss portion 20 includes a through-hole 23, and the projecting end of the fixed bracket 22 extends into the through-hole 23.

Figure 3:
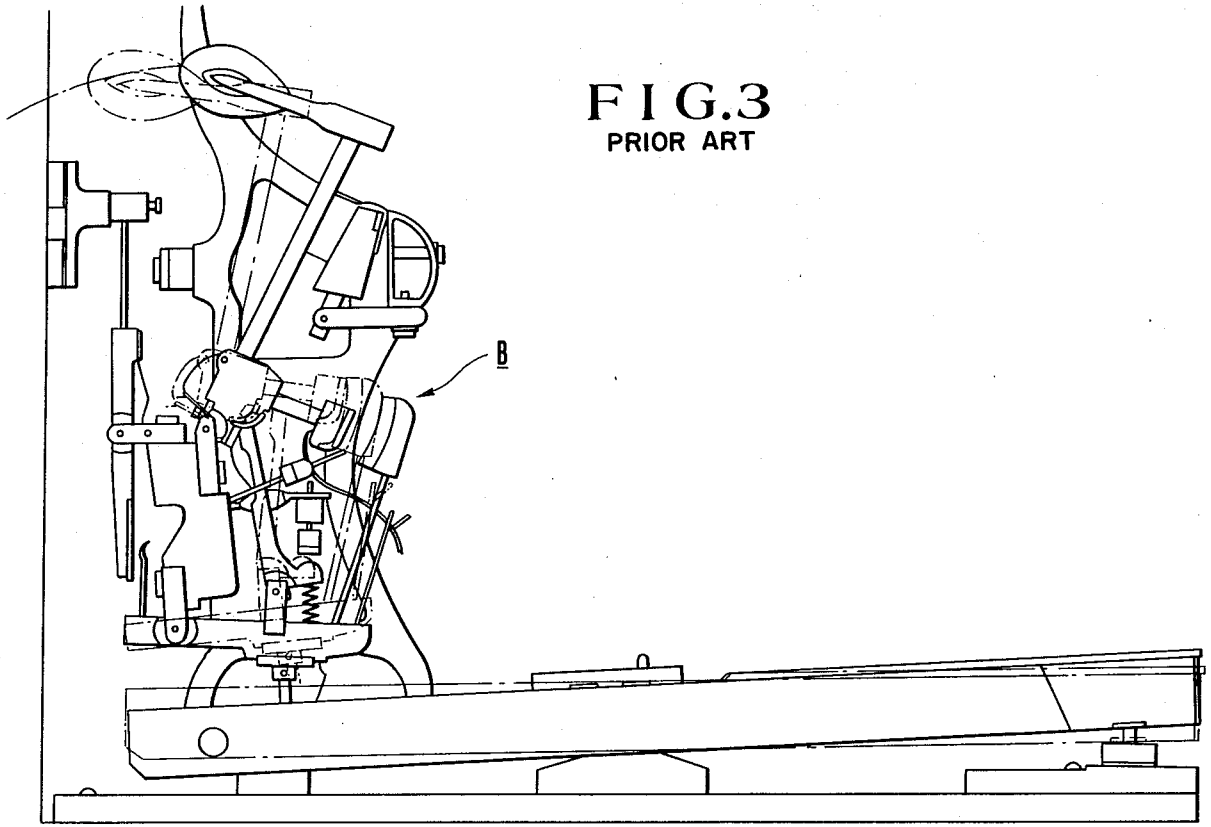
FIG.3 PRIOR ART
FIG. 3 is a schematic diagram of one example of the action mechanism of the prior art.
Figure 5:
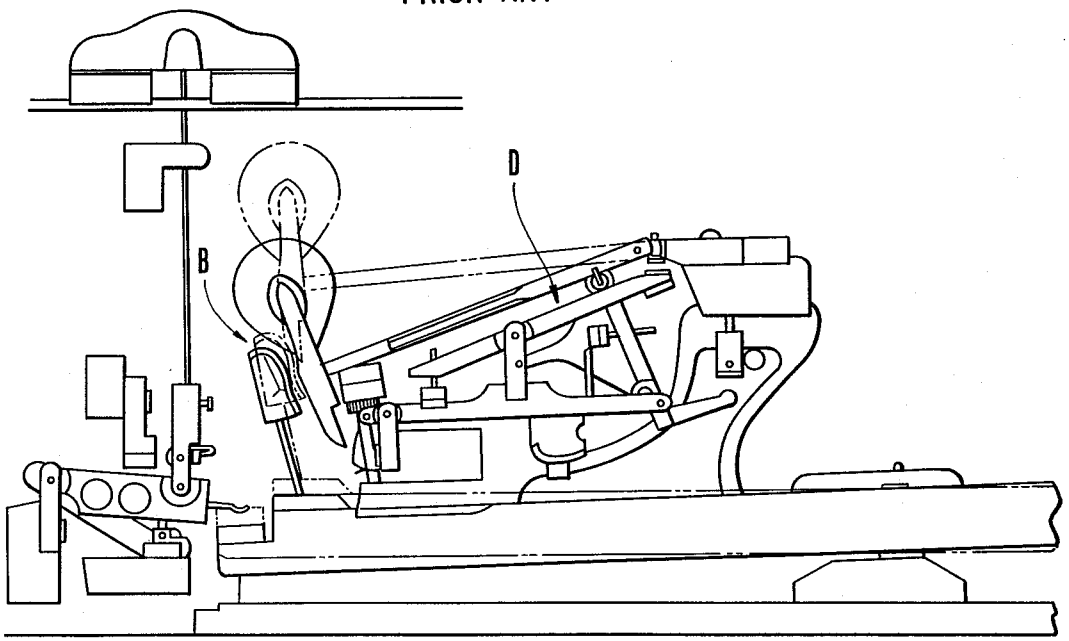
FIG.5 PRIOR ART
FIG. 5 is a schematic diagram of an action mechanism of a typical grand piano.

The aforesaid horizontal arm 21 has a back check mechanism B at its terminal end (the right-hand end as viewed in FIG. 1). The back check mechanism B serves to check the return of the hammer H at an intermediate position between the striking position and the rest position in order to facilitate a rapid repetition of a tone such as a trill. However, since the action mechanism 7 including the upright piano double escapement mechanism D shown in FIG. 1 is arranged so that the wippen 12 and the hammer 21 wing in opposite directions to each other, the action mechanism 7 needs a back check mechanism that is quite different from the back check mechanism B incorporated in the action mechanism of a conventional type of grand piano (FIG. 5) or upright piano (FIG. 3). The back check mechanism B shown in FIG. 1 includes a back check member 24 and a hammer check 25.

The back check member 24 is attached to the terminal end of the horizontal arm 21, and this terminal end defines an enlarged portion 21*a*. A resilient wire 24*a* is disposed upright on the inclined surface of the enlarged portion 21*a*, and the back check member 24 is attached to the upper end of the resilient wire 24*a*. A felt pad 24*b* is bonded to the concave surface of the member 24 that opposes the hammer check 25.

The hammer check 25 is attached to one end of a resilient wire 28 which is connected at the other end to wippen 12 in an upright manner. The hammer check 25 is adapted to come into slidable contact with the back check member 24 when the hammer H is reactively returned clockwise after it has struck the string C. The resilient wire 28 extends through through-holes 26 and 27, the through-hole 26 being formed in a second lever 33 which will be described later while the through-hole 27 is formed in the horizontal arm 21. A piece of buckskin 25*a* is bonded to the curved surface of the hammer check 25 that opposes the felt pad 24*b*. The buckskin 25*a* is of the type that produces large frictional resistance against the felt pad 24*b*.

Figure 4:
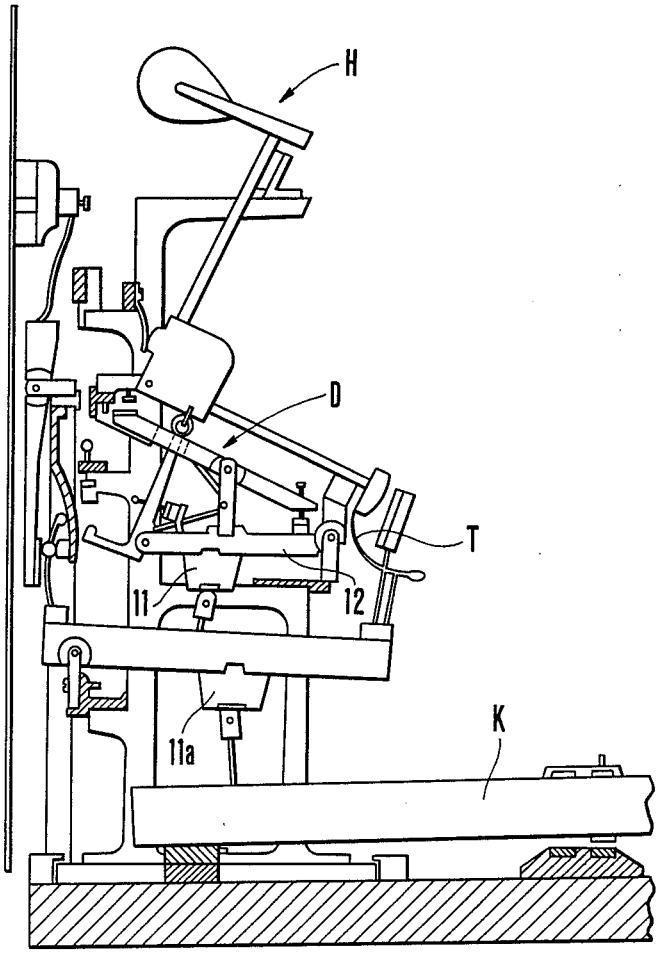
FIG.4 PRIOR ART
FIG. 4 is a side view, partially in section, of another example of the action mechanism of the prior art.

In the back check mechanism B having the aforesaid arrangement, the circular arc traced by the back check member 24 intersects that traced by the hammer check 25 and, in addition, the hammer check 25 is caught by the back check member 24 within the radius of the circular arc traced by the horizontal arm 21 (this catching has heretofore been performed outside the radius of the circular arc, as shown in FIG. 4). This arrangement contributes to the entire mechanism being compact, enables a positive catching of the hammer check 25 with the back check member 24, and effects a suitable balance of the action mechanism which influences key tough quality.

Since the back check member 24 is provided on the terminal end of the horizontal arm 21, the arm 21 is capable of rotating under the force of gravity in the direction away from the string C. This eliminates the need for bridle tapes or wires which have heretofore been used.

The hammer check 25 is positioned at a location higher than the position (as shown by a phantom line $T_2$ in FIG. 2) which is assumed by the horizontal arm 21 when the hammer H strikes the string C. In this arrangement, therefore the hammer check 25 is prevented from hindering the movement of the hammer H, thereby assuring satisfactory piano performance. In addition, in order to provide a relatively high degree of smoothness to the motion of the action mechanism 7, the back check member 24 and the hammer check 25 are respectively attached to resilient wires 24*a* and 28. Accordingly, the abutment position of the back check member 24 and the hammer check 25 can be easily adjusted merely by bending the resilient wire 24*a*.

Incidentally, a hammer stopper 29 is disposed on the top of the fixed frame 8*b*, and the balance of the hammer H may be adjusted by providing a balance weight W at a predetermined location. In the embodiment shown in FIG. 1, the balance weight W is provided in the horizontal arm 21. But according to this invention, the balance weight W may be provided in the boss portion 20 or the hammer wood 18. Preferably the balance weight W may be provided on the end of the hammer wood 18 because the balance weight W if provided in the end of the hammer wood 18 would help the hammer H return rapidly to a catching line.

The double escapement mechanism D includes a first lever 31 and a second lever 33. The first lever 31 is pivotably supported by a shaft 30 attached to the end of the wippen 12 adjacent the string C while the second lever 33 is pivotably supported by a shaft 32 attached to the upper end of the repetition lever fork 15 which is disposed upright on the wippen 12. The movement of the first lever 31 is limited by a first stopper 34 while the movement of the second lever 33 is limited by the aforementioned second stopper 35.

Specifically, the first lever 31 is commonly called a jack, and includes a first jack 31*a* and a second jack 31*b*. The first jack 31*a* is adapted to strike a hammer roller 35 attached to the underside of the horizontal arm 21 which provides support for the hammer H. The second jack 31*b* is integral with the first jack 31*a*, and is adapted to abut the first stopper 34 to shift the first jack 31*a* from the position at which a jack 31*a* would strike the hammer roller 36, thereby preventing the jack 31*a* from striking the hammer roller 36.

The first stopper 34 is attached to one end of a regulating screw 34*a* which extends through the fixed bracket 22 and the fixed frame $S_4$. Adjustment of the first stopper 34 is performed merely by rotating the screw 34*a* from above, by means of a screwdriver or the like.

The second lever 33 is commonly called a repetition lever, and includes a through hole 37 extending in a left-hand portion thereof as viewed in FIG. 1, with one end of the first jack 31*a* extending through the through-hole 37. The second lever 33 further includes an adjustment screw 38 disposed at a right-hand portion thereof as viewed in FIG. 1. The adjustment screw 38 serves to adjust the inclination of the repetition lever (the second lever 33) with respect to the wippen 12, and the lower end of the adjustment screw 38 is normally maintained in contact with the wippen 12.

It is to be noted that an adjustment screw 39 is attached to the lengthwise midportion of the first jack 31*a*. The inclination of the first lever 31 with respect to the wippen 12 is adjusted by adjusting the length of the portion of the adjustment screw 39 that projects from the first jack 31*a* and altering the state of contact between the adjustment screw 39 and a stopper 40 which is disposed upright on the wippen 12.

A leaf spring 41 is disposed between the first and second levers 31 and 33, and the folded mid portion of the leaf spring 41 is attached to the aforesaid repetition lever fork 15. The leaf spring 41 has a long leg 41*a* and a short leg 41*b*. One end of the long leg 41*a* is engaged with first lever 31 in the vicinity of the shaft 30 which pivotably supports the first lever 31, and thus urges the first lever 31 counterclockwise about the shaft 30. One end of the short leg 41b is attached to the second lever 33, and thus urges the second lever 33 clockwise about the shaft 32.

More specifically, the double escapement mechanism D includes a first escapement $D_1$ and a second escapement $D_2$. The first escapement $D_1$ functions to allow escapement of the pressure applied to the hammer roller 36 by the first jack 31*a* of the first lever 31. The second escapment $D_2$ functions to first allow escapement of pressure acting upon the hammer H during the clockwise angular displacment of the wippen 12, that is, while the wippen 12 is being rotated clockwise. The first escapement $D_1$ includes the second jack 31*b*, the first stopper 34, the first jack 31*a* and the aforesaid through-hole 37 formed in the second lever 33 while the second escapement $D_2$ includes the second lever 33 and the second stopper 35.

After the first and second escapements $D_1$ and $D_2$ have operated to allow the aforesaid escapement of pressure, even if the piano key K is not returned to its original position, i.e., the position shown in FIG. 1, the second lever 33 and the first jack 31*a* are urged under the resilient force of the leaf spring 41 to return to the position which allows the jack 31*a* to strike the hammer roller 36.

The first mechanism 6 includes a toggle mechanism 44 which has an actuating piece 44*a* and a pressing piece 44*b* and which is pivotally supported by a bracket 43 attached to the support frme $S_1$. The depressing force applied to the piano key K is transmitted to the lower end of a damper 45 through the actuating piece 44*a* and the pressing piece 44*b*. A damper lever fork 46 is attached to the support frame $S_2$ so as to project therefrom in a direction toward the string C, and such a damper lever 45 is pivotably attached to the damper lever fork 46. When the lower end of the damper lever 45 is pressed by the pressing piece 44*b* of the toggle mechanism 44, the damper 5 is released from the string C by the action of a resilient wire 47 attached to the upper end of the damper lever 45.

Figure 2:
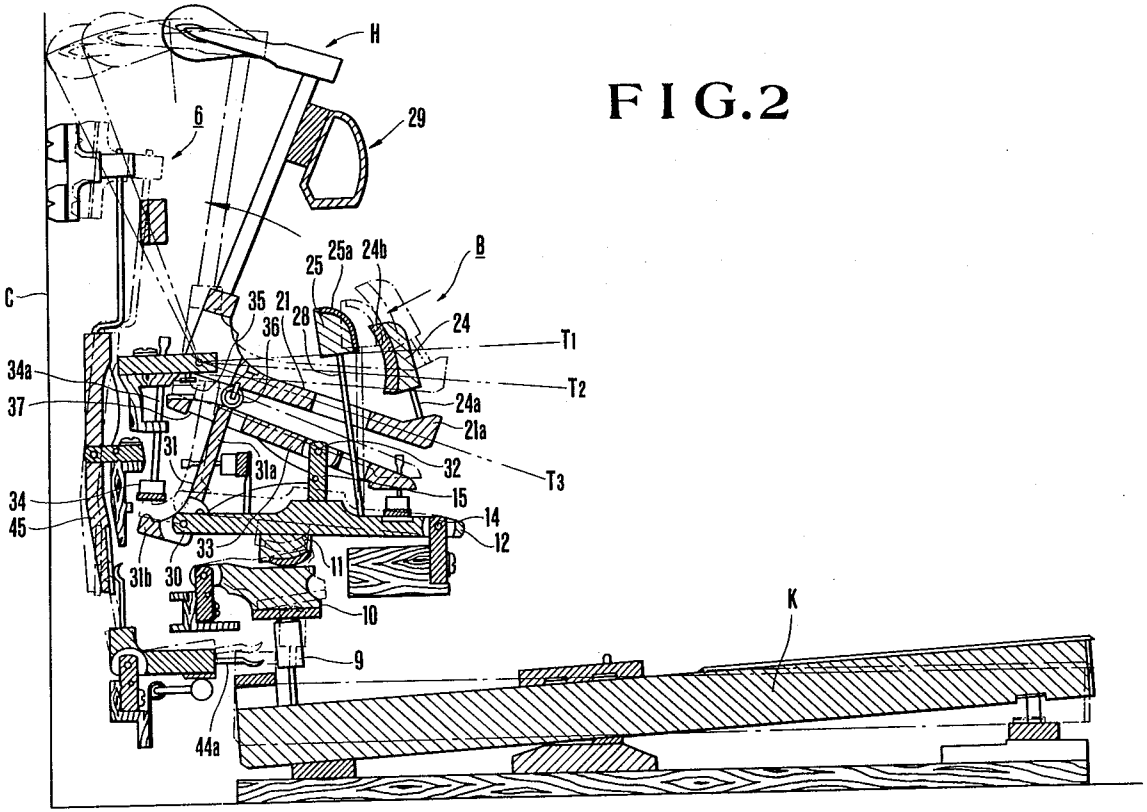
FIG. 2 is a view similar to FIG. 1 but showing manner in which the first embodiment operates.

The following is a description of the operation of the presently preferred embodiment of the invention with specific reference to FIGS. 1 and 2.

Referring again to FIG. 1 illustrating the piano key K in its rest position, when the piano key K is depressed in this state, the pillar 9 is moved upwardly to cause angular displacement of the wippen 12 about the shaft 14 through the intermediary of the wippen joint 10 and the wippen heel 11, thereby causing the first and second levers 31 and 33 to rotate in the clockwise direction.

Since the hammer roller 36 abuts the first and second levers 31 and 33, the horizontal arm 21 carrying the hammer H is moved counterclockwise to cause the hammer H to travel toward the string C as shown in FIG. 2.

When the second lever 33 is rotated unitl its left-hand end as viewed in FIG. 1 comes into contact with the second stopper 35, the hammer felt pad 17 of the hammer H is positioned about three millimeters away from the string C.

When the wippen 12 is further rotated in this state, the clockwise angular displacement of the second lever 33 is limited by the second stopper 35. Accordingly, the pressure acting upon the second lever 33 supported by the repetition lever fork 15 causes the second lever 33 to rotate about the second stopper 35 in the counterclockwise direction only, and thus does not force the hammer roller 36 upwardly. Specifically, at this moment, the second escapement $D_2$ serves to allow escapement of the pressure acting upon the hammer H.

Subsequently, when the wippen 12 is further rotated in this state, instead of the second lever 33, the first jack 31*a* presses the hammer roller 36. This pressure brings the second jack 31*b* into contact with the first stopper 34. This contact causes the first lever 31 to rotate counterclockwise about the shaft 30 within the through-hole 37 and thus the first lever 31 is shifted from a position at which it is pressed against the hammer roller 36.

On the other hand, the hammer H which has been thrust toward the string C by the first jack 31*a* continues its counterclockwise motion by inertia until it strikes the string C to generate a tone. This striking is effected along a striking line indicated at $T_1$ in FIG. 2. After such a striking, the hammer H is returned reactively to a catching line indicated at $T_2$ in FIG. 2. At $T_2$, the back check 24 comes into engagement with the hammer check 25, thus bringing the hammer H to a halt.

In other words, since the back check mechanism B is arranged so that the hammer H is stopped at an intermediate position before it reaches its original rest line $T_3$, it is possible to practice a piano playing technique in which a piano string is struck via a depression of the associated piano key K using a finger while the finger is being maintained at a position slightly higher than the piano key K.

When the string C is repetitively struck very rapidly, before the horizontal arm 21 returns to the catching line $T_2$, the hammer roller 36 of the horizontal arm 21 connected to the hammer H is received by the second lever 33 and at the same time the upper end of the first jack 31*a* is returned to a position immediately below the hammer roller 36, thus enabling the string C to be positively struck in a rapidly repetitive manner.

It will be appreciated that, if the piano key K is completely released, the aforesaid respective mechanisms are restored to the state shown in FIG. 1, thereby, enabling the upright piano to be played by practicing ordinary techniques.

As shown in FIG. 3, the prior art disclosed in Japanese Utility Model Laid-open No. 108,496/1983 it disadvantageous in that a second wippen or the like adversely affects the key touch quality and constructional balance of the associated action mechanism, thus resulting in a problem of relatively poor key touch quality. In accordance with the present invention, however, the use of the above-described back check mechanism succeeds in incorporating the double escapement mechanism into a typical upright piano without presenting such a problem.

The aforesaid double mechanism D is readily accessible and, in addition and the first stopper 34, the second stopper 35 are adjustable from above. Accordingly, the action of each key can be adjusted as desired. Furthermore, the hammer check 25 is adjustable from the front side of the piano.

Since many changes and different embodiments of this invention can be made without departing from the scope thereof, it is intended that all matter contained in the drawings and specification should be interpreted illustratively and not in a limited sense.

What is claimed is:

1. An action mechanism of an upright piano for transmitting thrust between a key and a hammer of the piano, said action mechanism comprising:

a piano key pivotally mounted in the piano about a fulcrum point between normal and depressed positions;

an L-shaped hammer pivotally mounted in the piano and movable between a string-striking position at which the hammer contacts a string and a rest position, said L-shaped hammer including a horizontal arm extending generally horizontally when the hammer is at said string-striking position and a vertical arm extending generally vertically when the hammer is at said string-striking position, and said L-shaped hammer biased to said rest position;

a pillar projecting from said piano key:

a wippen pivotally mounted in the piano and disposed between said piano key and said hammer for transmitting thrust from the piano key to the hammer when the hammer is depressed;

a wippen heel extending from said wippen toward said pillar;

a stationary shaft spaced from said wippen heel, said shaft having a longitudinal axis and mounted in the piano with said longitudinal axis immovably fixed in the piano;

a wippen joint pivotally mounted in the piano via said stationary shaft about the longitudinal axis thereof, said wippen joint extending between said pillar and said wippen heel, contacing said wippen heel, and pivotable as the piano key is moved from said normal position to said depressed position to transmit thrust from the piano key that pivots the wippen;

a double escapement mechanism supported by said wippen and operatively connected to said L-shaped hammer for transmitting pivotal movement of the wippen to the L-shaped hammer, said double escapement mechanism including first and second escapement means, said second escapement means for pivoting said hammer only a first predetermined amount between said rest and said string-striking positions during pivotal movement of said wippen, and said first escapement means for pivoting said hammer only a second predetermined amount between said rest and said string-striking positions after the hammer has been pivoted said first predetermined amount by said second escapement means, said first and said second predetermined amounts being less by a third pivotal amount than the total pivotal amount which said hammer is pivotal between said rest and said string-striking positions; and a back-check mechanism for checking the hammer at a temporary position located between said string-striking position and said rest position when said hammer has pivoted from said string-striking position toward said rest position by said third pivotal amount as the piano key moves from said depressed position toward said normal position, said back-check mechanism including a back-check member and a first resilient wire connected between said back-check member and the horizontal arm of said hammer, a hammer-check member and a second resilient wire connected between said hammer-check member and said wippen, said back-check member being inclined with respect to the horizontal from said horizontal arm toward the strings of the piano, and said hammer-check member being inclined with respect to the horizontal from said wippen toward the strings of the piano, said back-check member engagng said hammer-check member when the hammer has pivoted from said string-striking position toward said rest position by said third pivotal amount as the piano key is moved from said depressed position toward said normal position.

2. An action mechanism as claimed in claim 1, and further comprising a balance weight located on said hammer at a position at which the weight of the balance weight biases said hammer toward said rest position.

3. An action mechanism as claimed in claim 1, wherein the horizontal arm of said hammer includes a first surface extending generally horizontally when the hammer is at said string-striking position, and a second surface inclined with respect to said first surface, said first resilient wire extending generally perpendicular to said second surface.

* * * * *